US012606332B2

(12) United States Patent
Biondi et al.

(10) Patent No.: US 12,606,332 B2
(45) Date of Patent: Apr. 21, 2026

(54) PACKAGING UNIT FOR PACKAGING ARTICLES INTO BOXES AND RELATIVE PACKAGING METHOD

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT); Antonio Gigante, Bologna (IT)

(73) Assignee: R.A JONES & CO., Covington, KY (US)

( * ) Notice: Subject to any disclaimer, the term of this patent is extended or adjusted under 35 U.S.C. 154(b) by 0 days.

(21) Appl. No.: 18/865,664

(22) PCT Filed: May 29, 2023

(86) PCT No.: PCT/IB2023/055491
§ 371 (c)(1),
(2) Date: Nov. 13, 2024

(87) PCT Pub. No.: WO2023/233271
PCT Pub. Date: Dec. 7, 2023

(65) Prior Publication Data

US 2025/0326509 A1 Oct. 23, 2025

(30) Foreign Application Priority Data

Jun. 1, 2022 (IT) ..... 102022000011687

(51) Int. Cl.
*B65B 11/00* (2006.01)
*B65B 49/14* (2006.01)

(52) U.S. Cl.
CPC ..... *B65B 11/004* (2013.01); *B65B 49/14* (2013.01)

(58) Field of Classification Search
CPC ..... B65B 11/004; B65B 49/14
See application file for complete search history.

(56) References Cited

U.S. PATENT DOCUMENTS 1,875,986 A * 9/1932 Bronander ..... B65B 19/24 53/575
2,969,631 A 1/1961 Edgar et al.
(Continued)

OTHER PUBLICATIONS

International Search Report and Written Opinion for International Patent Application PCT/IB2023/055491, filed May 29, 2023 on behalf of R.A Jones & Co., Mailing Date: Aug. 29, 2023. 7 pages.

*Primary Examiner* — Andrew M Tecco
*Assistant Examiner* — Nicholas E Igbokwe
(74) *Attorney, Agent, or Firm* — Steinfl + Bruno LLP

(57) ABSTRACT

A packaging unit for packaging articles into boxes includes a mandrel and a folding device. The mandrel is configured to accommodate at least one of the articles and is adapted to be at least partially wrapped by a blank. The blank has an outer flap and an inner flap intended to be mutually overlapped and fixed so as to form a partially closed box. The folding device is configured to abut and fold the inner flap of the blank in the direction of the mandrel when the blank is at least partially wrapped onto the mandrel. A method for packaging articles into boxes includes arranging, abutting, and folding with the packaging unit.

16 Claims, 11 Drawing Sheets

(56) References Cited

U.S. PATENT DOCUMENTS

Figure 1:
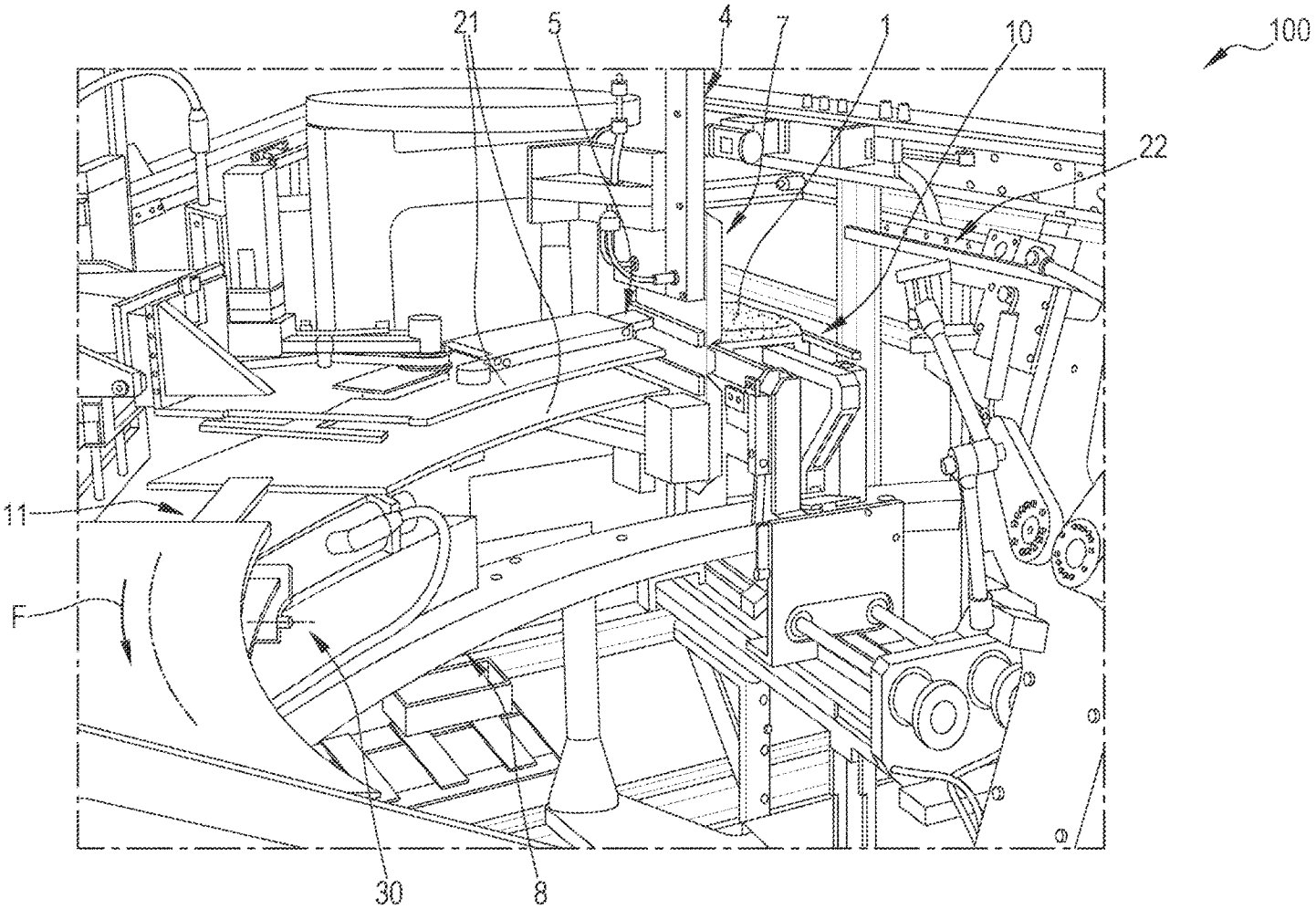

| | | | | | |
|---|---|---|---|---|---|
| 3,311,034 | A * | 3/1967 | Whitaker | B65B 19/24 | 53/575 |
| 3,875,724 | A * | 4/1975 | Langen | B65B 11/004 | 53/462 |
| 4,221,107 | A * | 9/1980 | Langen | B65B 43/265 | 53/575 |
| 5,115,625 | A * | 5/1992 | Barbulesco | B65B 7/20 | 53/284 |
| 7,559,186 | B2 * | 7/2009 | Smith | B65B 49/12 | 53/232 |
| 2010/0200371 | A1 * | 8/2010 | Reuteler | B31B 50/00 | 198/732 |

* cited by examiner 7
7e
16
7f
32
31
22

7
22
7e
7f
31
32

7
2
22
31
32

PACKAGING UNIT FOR PACKAGING ARTICLES INTO BOXES AND RELATIVE PACKAGING METHOD

CROSS REFERENCE TO RELATED APPLICATIONS

The present application is the U.S. national stage of International Application No. PCT/IB2023/055491 filed internationally on May 29, 2023, which, in turn, claims priority to Italian Patent Application No. 102022000011687 filed on Jun. 1, 2022.

DESCRIPTION

The present invention refers to a unit and a method for packaging articles into boxes.

The content of the following patent applications, filed by the same Applicant, is considered incorporated herein in its entirety:

Italian patent application No. 102022000011693 filed on 1 Jun. 2022 entitled "Packaging device for packaging articles into boxes and relative packaging method";

Italian patent application No. 102022000011699 filed on 1 Jun. 2022 entitled "Packaging device for packaging articles into boxes".

The present invention finds a preferred, though not exclusive, application in the field of packaging articles of variable geometry and which are relatively delicate in boxes, such as bags of cereals, a field to which reference will be made later without losing generality.

In particular, in the relevant technical field, packaging units are known in which the packaging of the article inside a box is obtained from a blank which is wrapped around the article.

This well-known packaging mode, also known as the "wrap-around" type mode, envisages the box being formed by wrapping the blank, e.g., a shaped cardstock, around a mandrel containing the article to be packaged. Such a mode envisages that the blank is wrapped around the mandrel so as to form a box closed laterally but open at least at one end thereof, from which the mandrel is then extracted, leaving the article inside the newly formed box. The open end can then be closed again, so that the resulting package can be sent to the final packaging steps.

In the present disclosure as well as in the accompanying claims, certain terms and expressions are deemed to assume, unless otherwise expressly indicated, the meaning expressed in the following definitions.

The term "article" means any product which can be packaged into boxes. The articles can have a predefined geometric shape or they can have a variable geometry.

Non-exclusive examples of such articles are known from the food and confectionery sector and can refer to loose articles or those contained inside bags, pouches or other types of wrapper.

Preferably, the articles are food and confectionery articles, either loose or contained inside bags or other types of wrapper, such as bags of cereals or capsules of coffee or other brewing beverages, individual chocolates (wrapped or unwrapped), candies, pouches containing solid, liquid or semi-solid food products; in addition, articles from the ceramic industry, absorbing articles for sanitary use, articles from the tobacco industry, articles from the cosmetics industry, articles from the pharmaceutical industry, articles from the personal & home care industry.

"Packaging" of one or more articles in a box means obtaining a box containing said one or more articles. Such packaging can be obtained by forming a box around the article to be contained.

"Mandrel" means a support capable, on the one hand, of accommodating and supporting the article to be packaged and, on the other hand, of providing an effective abutment for folding the blank when wrapped around the same.

"Blank" means a shaped sheet of suitable material and thickness adapted to be wrapped by folding around a mandrel to form a box. Panels are identified in the blank, delimited by preferred folding lines, which form the walls of the formed box. Preferably, the blank is made of cardboard or cardstock.

"Box" means any container adapted to contain one or more articles for the purpose of packaging them, which can be made from a blank by folding around a mandrel and subsequent fixing at its edges or panels.

A box is "partially closed" when it has at least one closed contour section, most preferably when it is closed laterally around the mandrel while the longitudinal ends are kept open.

A "flap" refers to a region of the blank that allows fixing the blank to another region in such a way as to form an at least partially closed box, preferably around a mandrel.

Some non-limiting examples of such a fixing are gluing, stapling and jointing by means of interlocking elements or elements with laces and hooks (Velcro®). In particular, the fixing to form an at least partially closed box takes place by at least partially overlapping two flaps of the blank, an inner flap and an outer flap.

Specifically, it is intended to indicate with "outer flap" the flap that, overlapped on the inner flap, is located outside the at least partially closed box, whereas it is intended to indicate with "inner flap" the flap that, overlapped on the outer flap, is located between it and the inside of the at least partially closed box. The "folding line" of a blank is defined as a predefined line around which two portions or panels of the blank are envisaged to rotate relative to each other so as to fold the blank, preferably around the mandrel.

The folding line can be a virtual line even if it is predefined.

The folding line is preferably defined by a weakening line obtained on the blank, e.g., a crease, or a scoring or a plurality of aligned holes.

In general, a first element is configured to "abut" a second element when the first element is arranged to touch the second element by exerting pressure thereon.

"Retaining device" means a device which, during the movement of the mandrel along its trajectory, retains the panels of the blank wrapped on the mandrel, against abutment surfaces of the mandrel, so that the closure of the box is made, by overlapping corresponding portions or flaps of panels of the blank and their mutual fixing, e.g., by gluing.

The term "vertical" means an orientation extended parallel to the direction of the force of gravity.

The term "horizontal" means an orientation extended substantially perpendicular to the vertical direction.

In "wrap-around" type packaging processes, it is provided that the article to be packaged is fed along a transport line to be transferred and accommodated inside a mandrel. Said mandrel is moved along a trajectory of movement of a forming path in which the step of wrapping the blank around the mandrel occurs with the formation and closure of the box, e.g., by gluing overlapped flaps thereof.

In the first box formation step, it is envisaged that the blanks are inserted one at a time in the forming path. This insertion operation is carried out so that a respective mandrel intercepts a corresponding blank along the trajectory of movement in a position intersecting the trajectory. In a subsequent operating step, a folding device arranged along the trajectory is envisaged to cooperate with the mandrel so as to fold at least one panel of the blank being wrapped around the mandrel. Preferably, it is envisaged that a pair of panels of the blank, forming opposite walls of the box, are folded being wrapped around the mandrel and retained against the same, e.g., by sliding the mandrel along the trajectory, between a pair of opposite abutments, e.g., between a pair of plates spaced from each other so as to allow the mandrel to slide and the retaining action of the blank panels against the mandrel.

The Applicant has been able to observe how one of the critical steps for packaging articles inside a box by means of a wrap-around type packaging process is the closing of the blank once it is wound around the mandrel. This closure envisages a series of distinct operations, such as folding and closing the rear panel that is located rearward with respect to the advancement direction of the mandrel.

In particular, the rear panel is closed by folding an outer flap that is moved by the closing member by overlap of an inner flap, for their relative gluing when the flaps are pressed in abutment against the mandrel.

By operating in this manner, the Applicant has observed that, in order to ensure the correct overlap between the outer and inner flaps, it is necessary that the inner flap assumes a position that is at least partially folded around the corresponding folding edge of the mandrel, when it is impacted by the outer flap. Otherwise, in fact, jams could occur between the flaps or even the case could occur in which the inner flap is not impacted by the outer flap. In all conditions, in which there is no correct condition of relative overlap, there is therefore a risk that the flaps are not correctly glued together, compromising the closure of the box.

The Applicant has also found that introducing a possible step of at least partial folding of the inner flap, for example by inducing a yielding around its folding line, as moreover some known solutions suggest, carried out prior to wrapping the blank around the mandrel, cannot guarantee with certainty that the inner flap assumes or maintains a fold suitable to allow the correct impact of the outer flap. In fact, the yielding of the inner flap is in any case subject to a partial release due to the elastic return, the extent of which may vary depending on the dimensions and thickness of the blank as well as on the nature of the material with which it is made.

The Applicant has therefore understood that, in order to guarantee a precise relative positioning between the inner and outer flaps, for their gluing in the correct condition of relative overlap, it is appropriate that the inner flap is abutted in the folded position until the outer flap is moved to a position close to the inner flap, in such a way as to ensure that the outer flap, in its movement, impacts correctly against the inner flap.

The Applicant has finally found that a folding device configured to abut and fold the inner flap of the blank in the direction of the mandrel when the blank is wrapped on the mandrel, could guarantee, in the step of folding the inner and outer flaps, against each other, their precise positioning, in the correct condition of relative overlap, for the closure of the box.

Therefore, in a first aspect thereof, the present invention is directed to a packaging unit for packing articles into boxes, comprising a mandrel.

Preferably, said mandrel is configured to accommodate therein at least one of said articles.

Preferably the mandrel is adapted to be at least partially wrapped by a blank. Preferably the blank has an outer flap and an inner flap intended to be mutually overlapped and fixed so as to form a partially closed box.

Preferably said packaging unit comprises a folding device.

Preferably such a folding device is configured to abut and fold the inner flap of the blank in the direction of the mandrel when the blank is at least partially wrapped onto the mandrel.

In a second aspect thereof, the present invention is directed to a method for packaging articles into boxes.

Preferably said packaging method comprises the step of arranging a blank at least partially wrapped around a mandrel containing therein one or more of said articles.

Preferably said packaging method envisages the step of forming a partially closed box around the mandrel such that the at least partially wrapped blank has an outer flap and an inner flap intended to be mutually overlapped and fixed to form the partially closed box.

Preferably said packaging method envisages the step of abutting and folding by means of a folding device the inner flap in the direction of the mandrel by moving said folding device towards the mandrel when the blank is at least partially wrapped onto the mandrel.

Thanks to these features, the folding of the inner and outer flaps takes place in a precise way ensuring that the outer flap, in its folding movement towards the mandrel, meets the inner flap impacting correctly against it, so as to ensure that the inner and outer flaps are in the correct condition of relative overlap, for their gluing.

In at least one of the aforementioned aspects, the present invention may further have at least one of the preferred features set forth below.

In a preferred embodiment, the folding device comprises at least one hitting element movable with respect to the mandrel between a first position far from the mandrel and a second position close to the mandrel such that the inner flap is folded towards the mandrel.

In a preferred embodiment, the packaging unit comprises a driving device for moving the hitting element between the first position and the second position. In a preferred embodiment, said mandrel comprises a folding edge for the inner flap of the blank and said at least one hitting element is configured to press the inner flap for at least a prevailing portion of the inner flap dimension developed along said folding edge.

Preferably the hitting element presses the inner flap for at least 50% of the dimension of said flap and more preferably for at least 80% of said extended dimension in the longitudinal direction of the folding edge.

In a preferred embodiment, said at least one hitting element comprises at least one plate bearing an end edge intended to press the inner flap of the blank. In a preferred embodiment, said at least one hitting element is moved between said first and second positions by a rotation motion about a rotation axis.

Thanks to this feature, the realization of the folding device turns out to be a simple implementation solution, which proves particularly suitable when the mandrel is driven at high speeds.

Preferably, two hitting elements are provided spaced from each other and intended to abut respective end regions of the inner flap, a plane of retention of the blank being wrapped on the mandrel being extended between said hitting elements.

Thanks to this feature, a continuous retention is ensured for the blank wrapped on the mandrel in abutment on said retention plane, during the folding step of the inner flap.

Preferably said at least one hitting element extends radially to the rotation axis. In a preferred embodiment, the mandrel is moved along a circular trajectory contained in a movement plane, said rotation axis being tilted with respect to said plane and the end edge of the at least one hitting element extending parallel to said plane, so that said end edge is substantially parallel to the folding edge of the mandrel in the second position.

Thanks to this feature, the impact against the inner flap takes place simultaneously along the entire surface development of the inner flap ensuring that the pressure action against the inner flap is exerted in a uniformly distributed manner.

Preferably the end edge of the at least one hitting element is driven to rotate about said rotation axis along a trajectory with a conical surface profile.

In a preferred embodiment, said packaging unit comprises a retaining device movably guided along at least a section of a trajectory of movement of the mandrel and configured to cooperate with the mandrel, for retaining the blank, wrapped on the mandrel, against at least one abutment surface of the mandrel, wherein the at least one hitting element of the folding device is assembled on said retaining device.

Thanks to this feature, the folding device can be effectively used if there is a need for the retaining device to move to and from the mandrel, typically in the presence of low speeds of the mandrel. Furthermore, since the motion of the folding device is associated with the motion of the retaining device, the movement of the folding device is simpler to implement.

In a preferred embodiment, said retaining device comprises a plate-shaped head and said hitting element is hinged to said plate-shaped head to be able to swing between said first position and second position.

In a preferred embodiment, said hitting element comprises an appendage slidably coupled to a guide driven transversely to the trajectory of movement of the mandrel, so that in the movement of the retaining device the hitting element is moved between said first position and second position.

In a preferred embodiment, the packaging method comprises the steps of arranging and moving at least one hitting element of said folding device with respect to the mandrel between a first position far from the mandrel and a second position close to the mandrel for folding the inner flap of the blank in the direction of the mandrel.

In a preferred embodiment, the method comprises the step of moving the at least one hitting element between said first position and second position by means of a rotation movement driven around a rotation axis.

In a preferred embodiment, the method comprises the steps of arranging and guiding a retaining device along at least a section of a trajectory of movement of the mandrel, said retaining device being configured to cooperate with the mandrel, for retaining the blank, wrapped on the mandrel against at least one abutment surface of the mandrel, the method further comprising the step of assembling the at least one hitting element of the folding device on said retaining device.

In a preferred embodiment, the method comprises the step of driving the at least one hitting element of the folding device in a swinging movement relative to the retaining device, between said first position and second position.

It should be specified that some steps of the method described above may be independent of the order of execution reported. In addition, some steps may be optional. In addition, some steps of the method may be performed repetitively, or may be performed in series or in parallel with other steps of the method.

Figure 2:
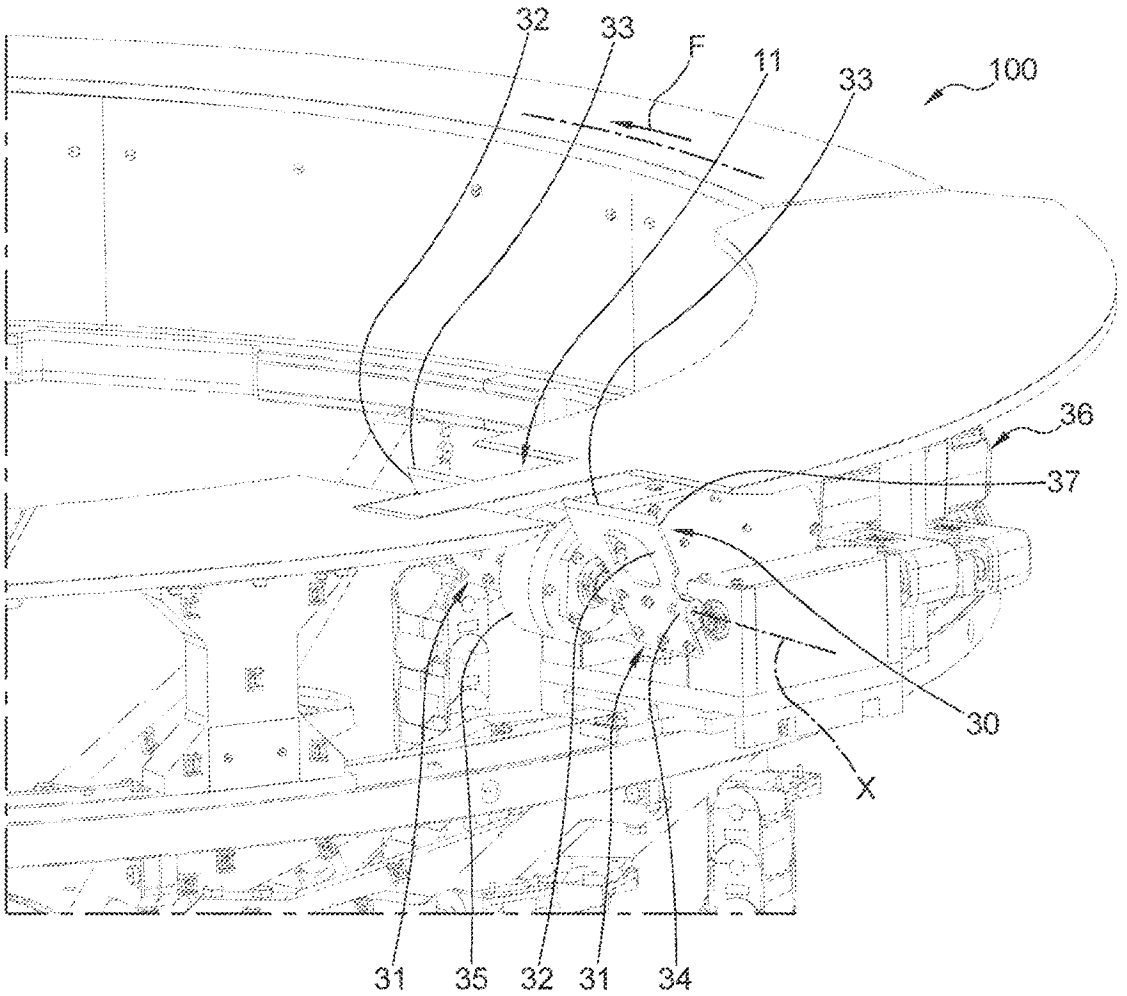
Figure 3:
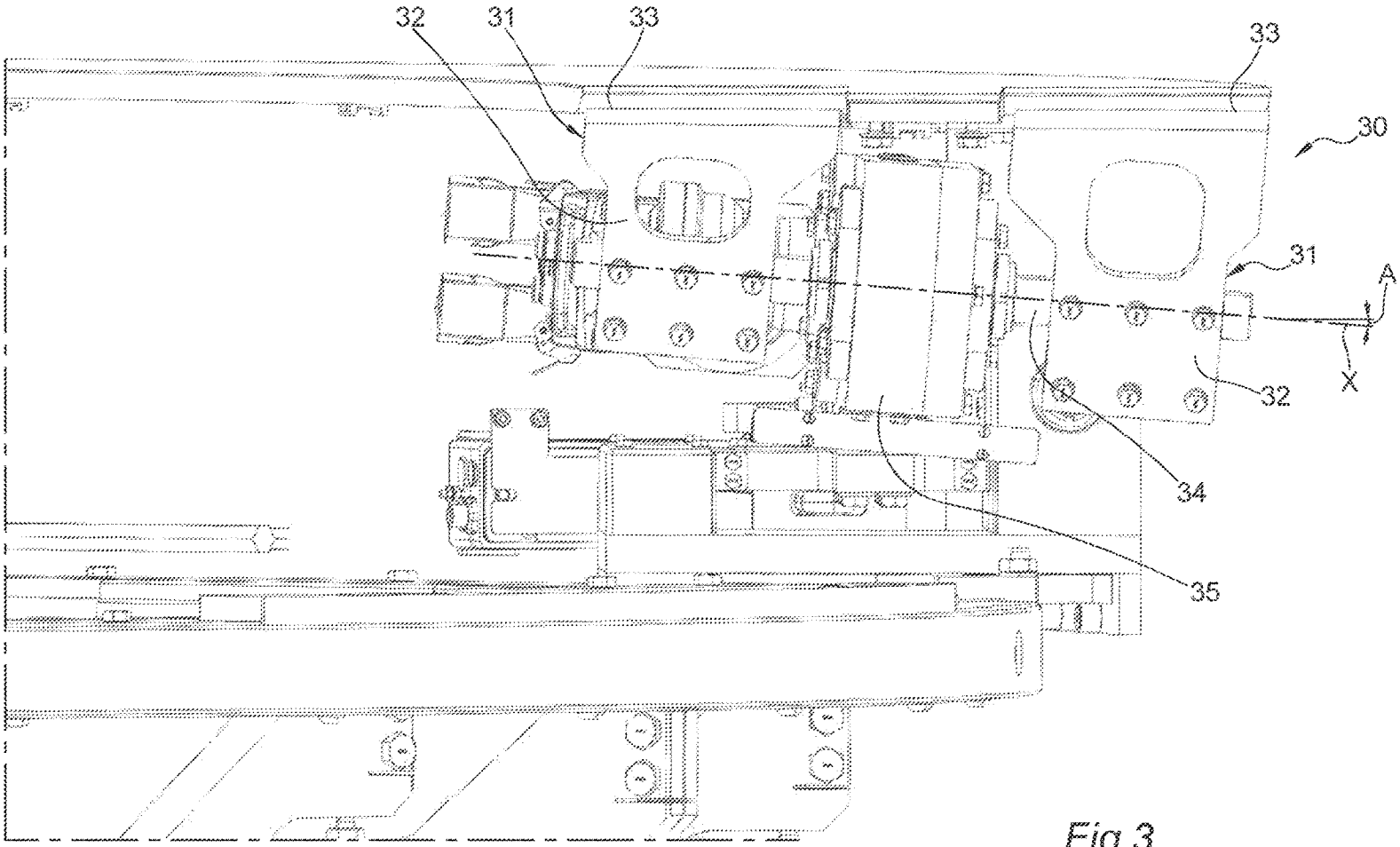
Figure 3B:
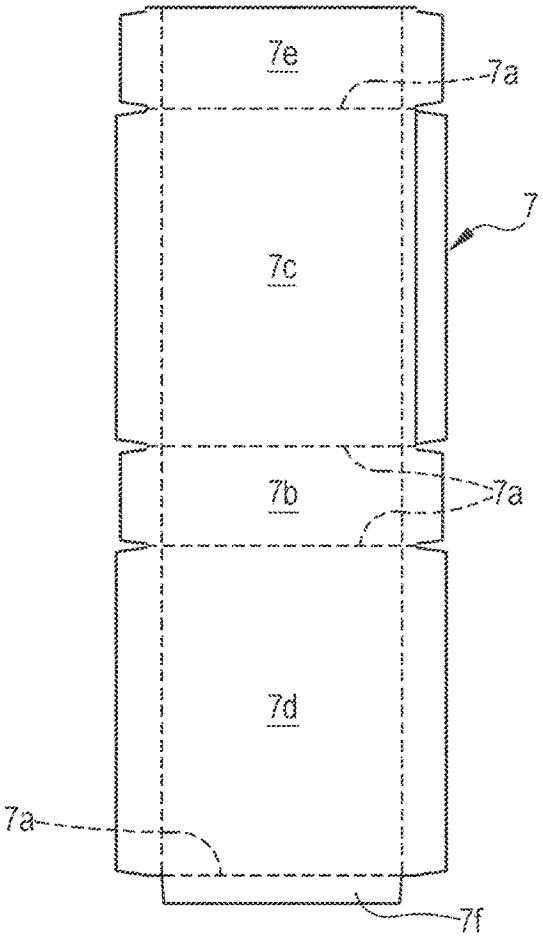
Figure 3A:
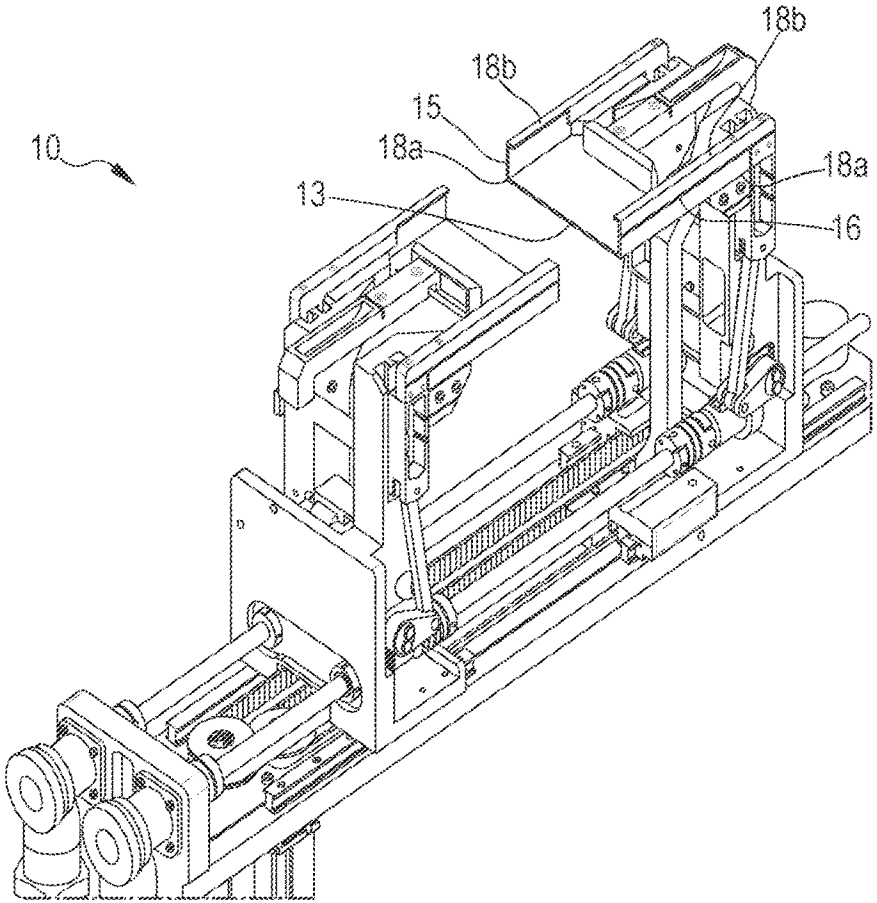
Figure 7:
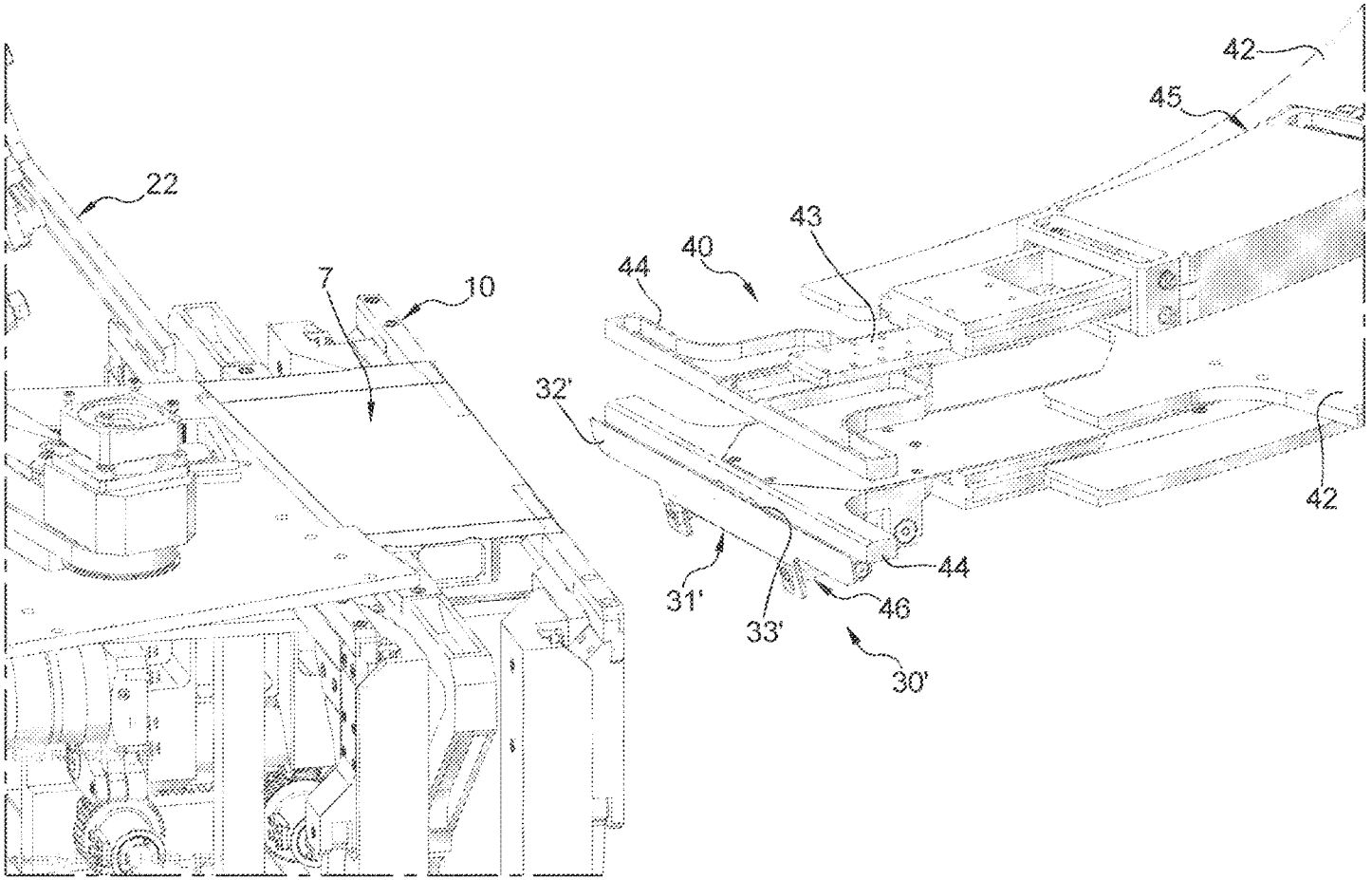
Figure 8:
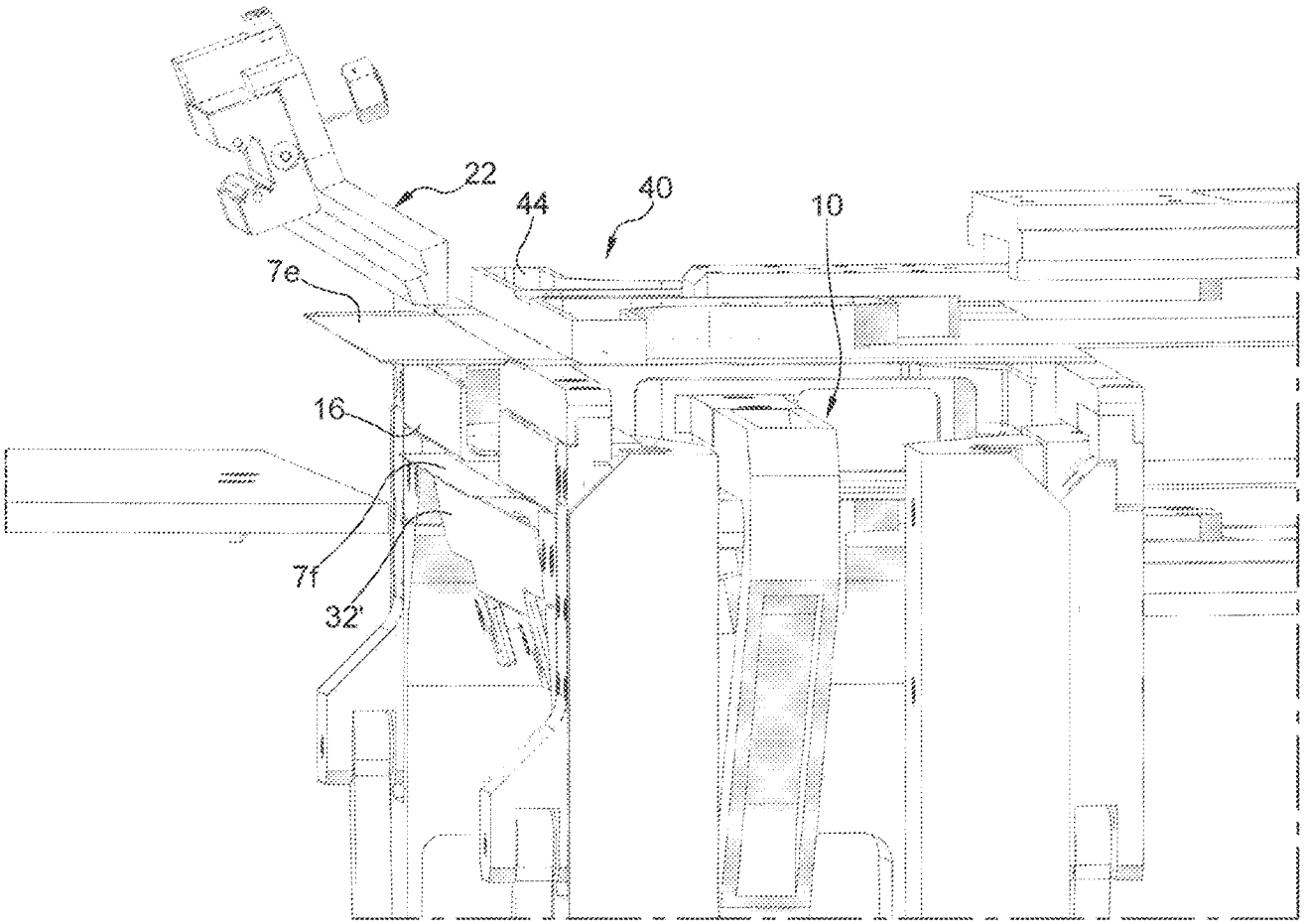
Figure 9:
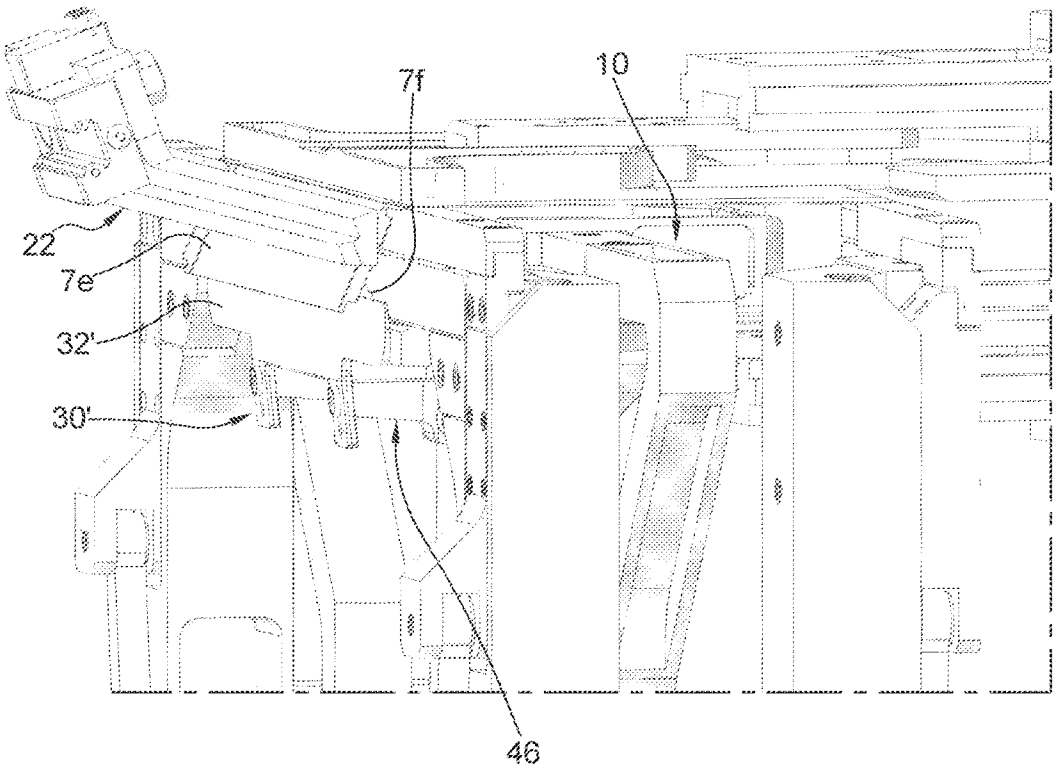
Figure 10:
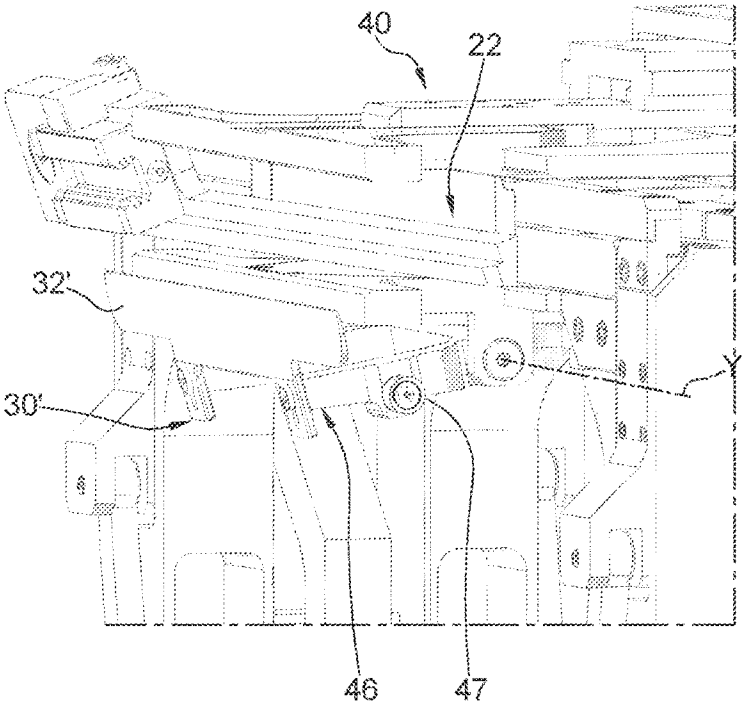
Figure 11:
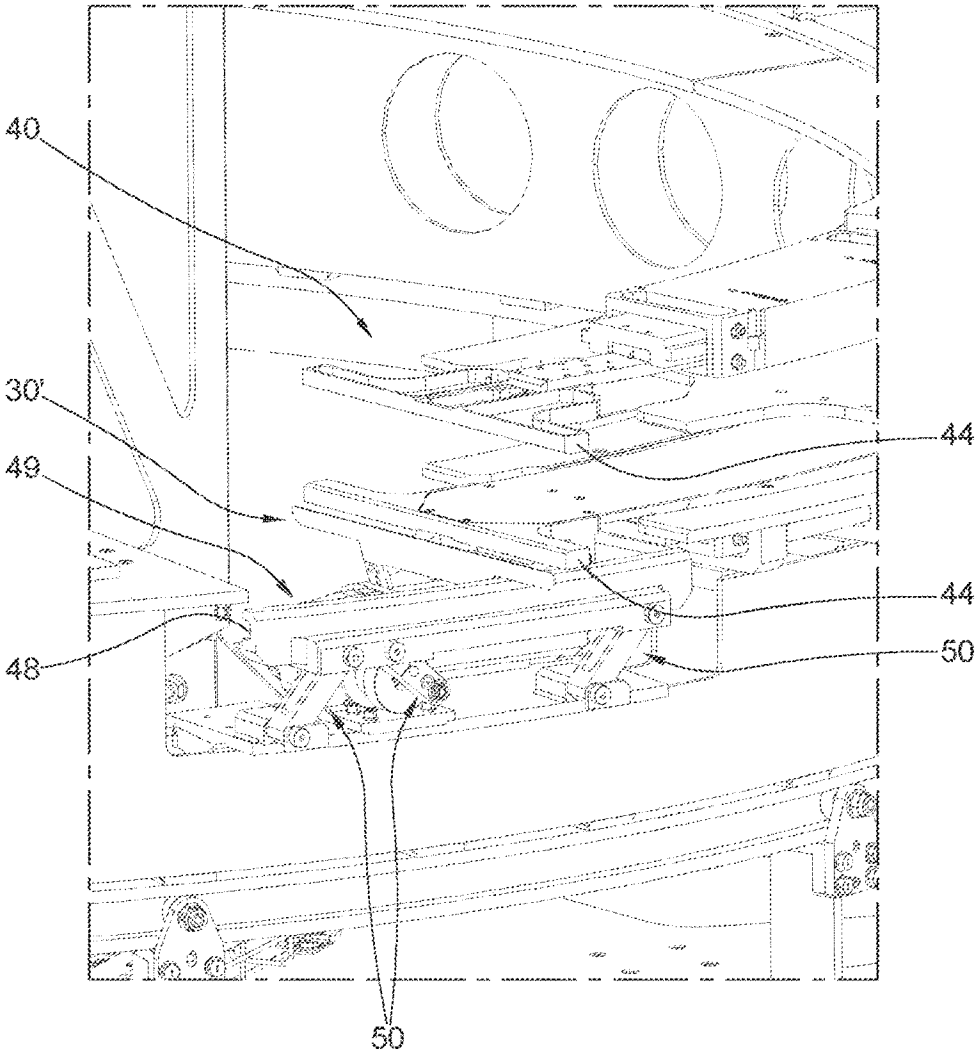
Figure 12:
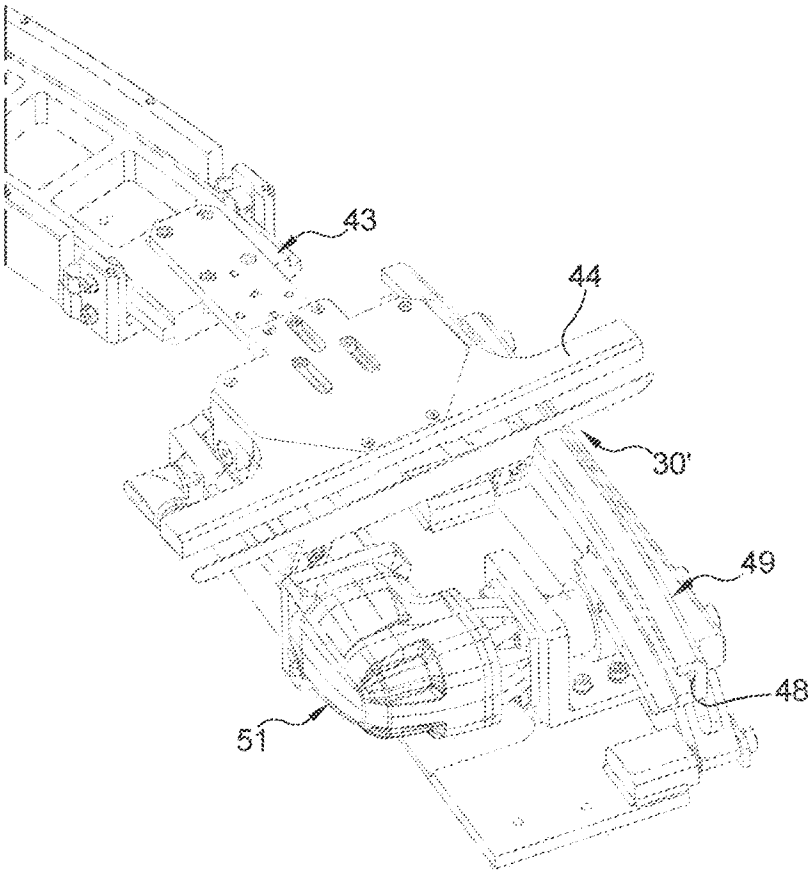

The characteristics and advantages of the present solution will best result from the detailed description of some preferred embodiments thereof, illustrated by way of non-limiting example with reference to the accompanying drawings, in which:

FIG. 1 is a partial schematic and perspective view from above of a first example of packaging unit for packaging articles into boxes made in accordance with the present invention, FIG. 2 is a partial perspective view of a detail of the packaging unit of FIG. 1, FIG. 3 is a further partial perspective view of the detail of FIG. 2, FIG. 3A is a partial schematic view, in perspective, of a mandrel of the packaging unit of the previous figures, FIG. 3B is a schematic front elevation view of a blank intended to be wrapped on the mandrel shown in FIG. 3A, FIGS. 4 to 6 are schematic side elevation views of the detail of FIG. 3, in respective and distinct operating steps, FIG. 7 is a partial perspective view of a second embodiment example of the packaging unit in accordance with the present invention, FIGS. 8 to 10 are schematic perspective views of a detail of FIG. 7 shown in respective and distinct operating steps, FIGS. 11 and 12 are further perspective views of the detail of FIG. 7.

With initial reference to FIG. 1, a packaging unit made in accordance with a first embodiment example of the present invention is indicated overall with 100. The packaging unit 100 is arranged to package one or more articles 1 inside boxes 2.

The articles 1 are, in this preferred embodiment example, bags containing granular, loose or bulk food products, e.g., cereal flakes.

The packaging unit 100 comprises, in its most general components, an article feeder, a blank feeding device 4 and a folding device 5 of the blanks.

The article feeder can be made in any form adapted to pick up an article 1 from an upstream work station (or from a warehouse) and deliver it to the devices of the packaging unit.

The blank feeding device 4, in turn, is configured to pick up a single blank 7 from a group of blanks stacked in a stacking zone and bring it in the packaging unit. For example, the blank feeding device 4 may comprise a plurality of gripping members assembled on a carousel rotatable about a substantially vertical axis.

The packaging unit 100 is arranged to receive each article 1 from the article feeder and form a respective box 2 around the same, starting from a blank 7 supplied by the blank feeding device 4.

For this purpose, the packaging unit 100 comprises a mandrel 10 assembled on a carousel 8, rotatable around a vertical axis, so that the mandrel is moved along a circular trajectory in an advancement direction F. The trajectory is conveniently contained in a horizontal plane.

Thereby, the mandrel 10 is driven along the circular trajectory between a receiving zone, in which the mandrel 10 receives an article 1 from the article feeder, an abutment zone, in which the mandrel 10 abuts a blank 7 supplied by the blank feeding device 4, a forming zone, in which the blank 7 is folded, being wrapped around the mandrel 10, so as to form a box 2 containing the article 1, an unloading zone, in which the box 2 containing the article 1 is delivered to the subsequent processing stations and, finally, a return zone in which the mandrel 10 is returned to the receiving zone.

In the embodiment described herein, the mandrel 10 consists of a pair of mutually separate and distinct units, both assembled on an arm radially extended from the carousel 8.

With reference to the vertical axis around which the carousel 8 rotates, the two units forming the mandrel 10, which are substantially identical to each other, are arranged facing each other in a radial direction, and along such a radial direction they are moveable with respect to each other, between an operating position, in which the two units are approached one another, and a non-operating position in which they are spaced apart from each other, so as to decompose the mandrel 10. The radial direction also identifies a direction of longitudinal development of the mandrel 10, and the advancement direction F of the mandrel 10, along the circular trajectory, is thus directed transversely, and in particular is perpendicular, to the aforementioned radial direction.

On the mandrel 10, in its configuration with the two units approached one another, there is identified a lower wall 13, defining the bottom surface on which the article 1 is deposited, as well as a pair of side walls 15 and 16, delimiting the lower wall 13 at the opposite longitudinal sides.

On each side wall 15, 16, there is also identified a lower edge 18*a*, which is substantially coplanar with the lower wall 13, and an upper edge 18*b*, spaced apart from and substantially parallel to the lower wall 13.

The pairs of lower 18*a* and upper 18*b* edges constitute the folding edges around which the blank 7 is folded for the formation of the box 2. In this embodiment example, the pairs of folding edges are configured to make the box 2 assume a parallelepiped shape with pairs of opposite side faces parallel to each other. The pair of upper edges 18*b* defines an upper abutment surface, which is extended parallel to the lower wall 13, for the blank 7.

Similarly, the side walls 15,16 and the bottom wall 13 define, on the corresponding outer sides of the mandrel 10, respective abutment surfaces of the folded blank being wrapped around the mandrel 10.

The blank 7 is made of cardstock and is suitably shaped to form a box 2 when folded around the mandrel 10.

For this purpose, folding lines 7*a* are obtained in the blank 7 which divide the blank 7 into a plurality of panels intended to form, alone or in combination between them, the different faces of the box 2.

The folding lines 7*a* are preferably creases, and each pair of adjacent panels can be swung around a respective folding line 7*a* separating them.

In particular, in the blank 7 there is identified a central panel 7*b* which is intended to be abutted as first by the mandrel 10 in the formation of box 2, as well as two panels 7*c*, 7*d* extended from the upper side and from the lower side of the central panel 7*b*, respectively, and separated therefrom by respective folding lines 7*a*. A flap 7*e* is extended from the panel 7*c* and is intended for the partial closure of the box into the tubular shape, which, with the box formed, is parallel and opposite to the central panel 7*b* which is abutted as first frontally by the mandrel 10 in its advancement movement.

For the formation of the opposite bases of the box 2, from each of the panels 7*b*, 7*c*, 7*d* and from the flap 7*e* there are extended from opposite sides respective base panels which can swing with respect to the respective side panel at the crease joining them.

The tubular shape assumed by the partially closed box is obtained by joining the flap 7*e* with a flap 7*f* protruding from the panel 7*d*, which are brought into relative overlap and then joined together, e.g., by gluing.

The flap 7*e* is also referred to as "outer flap" in that it, when overlapped on the flap 7*f*, lies outside the at least partially closed box. Correspondingly, the flap 7*f* is also referred to as "inner flap" in that it, when overlapped on the flap 7*e*, lies between the latter and the inside of the at least partially closed box.

The folding device 5 is of the type comprising a pair of plates 21 positioned on the circular trajectory of the mandrel 10 immediately downstream of the point where the blank 7 is delivered to the packaging unit by the blank feeder device 4.

The plates 21 are parallel and opposite each other as well as mutually spaced so that the mandrel 10 can be dragged therebetween at a close distance between each of the two plates 21 and the lower and upper edges 18*a*, 18*b* of the side walls 15, 16 of the mandrel 10.

At the mouth defined between the plates 21, further folding members can be provided, intended to impact the blank, for folding the panels being wrapped on the mandrel, before the latter is brought between the plates 21.

Figures 4, 5, 6:
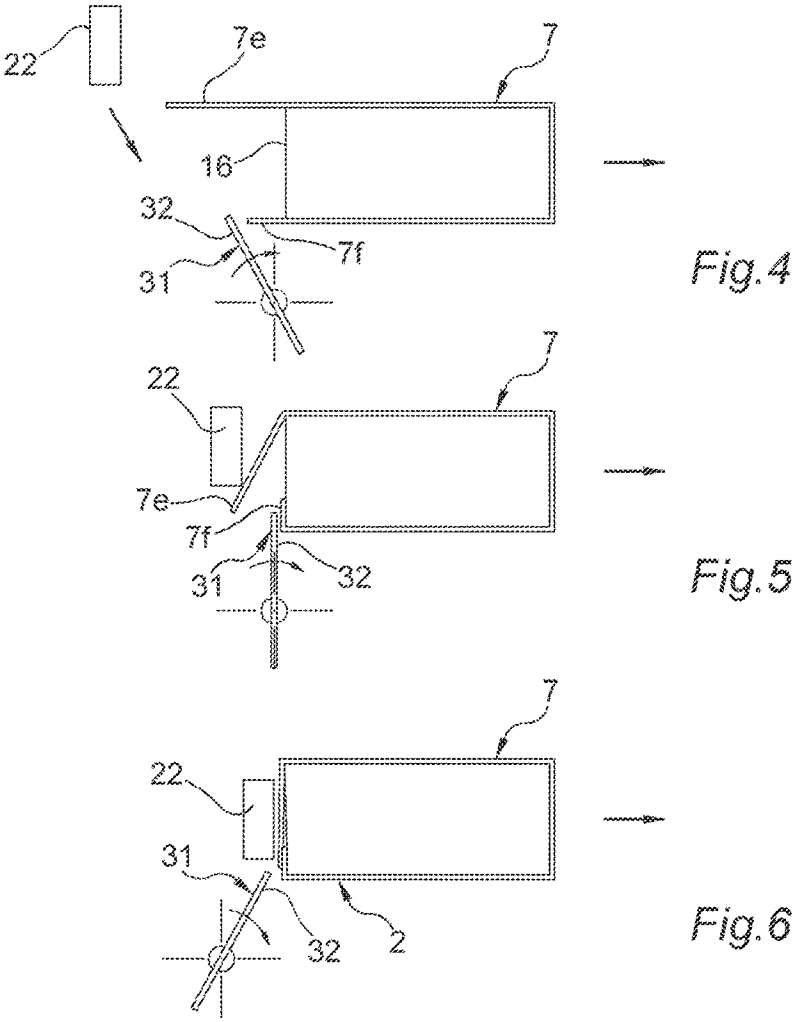

Upon exiting the pair of plates 21, the blank 7 thus assumes a folded configuration, in partial wrapping on the mandrel 10, wherein the central panel 7*b* is abutted by the side wall 15 of the mandrel 10, while the upper 7*c* and lower 7*d* panels are folded against the respective upper and lower abutment surfaces of the mandrel 10. Such a shape is schematically shown in FIG. 4. Downstream of the pair of plates 21, along the trajectory of movement of the mandrel 10, it is provided that a closing member 22, assembled on the mandrel 10, cooperates with the mandrel 10 in order to fold the outer flap 7*e* against the side wall 16 of the mandrel 10, bringing said outer flap into overlap with the inner flap, for their gluing, for example by providing glue points, so as to make the side closure of the box wrapped around the mandrel. The glue points are distributed on the inner surface of the flap 7*e* at a step prior to wrapping the blank on the mandrel.

The closing member 22, for example configured in the form of a bar, is controlled in a movement with which it is lowered from above on the trajectory of the mandrel 10 to perform the folding of the outer flap 7*e*, following the mandrel 10 in its advancement. This folding step is carried out in a section of the trajectory of the mandrel 10, extended downstream of the folding device 5, with respect to the advancement direction F of the mandrel 10.

In this section of trajectory there is provided a fixed retaining device, for example made in the form of a plate, on which a plane 11 is located intended to retain the lower panel 7*d* of the blank in abutment contact against the mandrel, during the advancement of the latter.

The packaging unit further comprises a folding device 30 configured to abut and fold the inner flap 7*f* of the blank 7 when the blank is wrapped on the mandrel, said abutment and folding actions being performed, following the mandrel in its advancement, along the trajectory section of the mandrel extended downstream of the folding device 5.

The folding device 30 comprises a pair of hitting elements 31, each hitting element including a respective plate 32 bearing a respective end edge 33 intended to press the inner flap 7*f* of the blank.

The plates 32 are assembled, spaced apart and in a coplanar configuration, on a shaft 34 driven to rotate about a rotation axis X. Said plates extend radially from the axis X and are axially spaced from each other at a central portion of the shaft 34 in which the shaft is coupled to a motion transmission system housed in a transmission box 35. A driving device including a motor 36 is provided for transmitting, through the transmission system, the rotation motion to the plates 32 about the axis X.

The retention plane 11 extends interposed between the pair of elements 31, as clearly shown in FIG. 2, such a configuration advantageously ensuring a continuous retention of the blank, and in particular of its lower panel, in abutment against the mandrel.

The provision of realizing the folding device 30 with the plates side by side, positioning the transmission system between the plates themselves, also allows to advantageously avoid overall encumbrances protruding laterally to the opposite axial ends of the shaft. Alternatively, in an embodiment variant, it may be provided that the folding device comprises a single hitting element, for example including a single plate with a respective end edge intended to press the inner flap of the blank, this configuration requiring the positioning of the transmission system at one of the axial ends of the shaft.

37 indicates a superficial lowering of the plate 32 extended along the end edge 33, and such as to give the plate a tapered shape with a slight concavity that is facing the inner flap of the blank during the operating functioning of the folding device. Thanks to this shape, the impact action of the folding device against the inner flap is made more effective, at the same time optimizing the width of the angular stroke in which the inner flap is abutted and folded by the folding device.

In the rotation about the axis X, the hitting elements 31 are driven, in a movement relative to the mandrel 10 advancing along its trajectory, between a position far from the mandrel and a position close to the mandrel, in which the hitting elements 31 reach the inner flange 7*f* by pressing said flap being folded towards the mandrel.

FIGS. 4 to 6 show a sequence of three significant positions assumed by the hitting elements 31 of the folding device in cooperation with the mandrel 10 and with the closing member 22.

FIG. 4 shows a position in which the closing member 22 and the folding device 30 are driven towards to the mandrel.

FIG. 5 shows a position in which the closing member 22 reaches and presses the outer flap 7*e* being folded towards the mandrel and the hitting elements 31 of the folding device reach and press the inner flap 7*f* being folded towards the mandrel. In the position of FIG. 5 the plates 32 of the folding device, in their rotation motion with the direction indicated in the figure, are substantially parallel to the side wall 16 of the mandrel, so that the inner flap 7*f* is folded substantially at 90° around the corresponding lower folding edge 18*a* of the mandrel, near the wall 16 of the mandrel. In this position the hitting elements 31 are interposed between the outer flap 7*e*, which continues to be pressed and folded by the closing member, and the inner flap 7*f*, without however, during movement, there being any contact between the outer flap 7*f* and the hitting elements 31.

In a subsequent position of the rotation, shown in FIG. 6, the hitting elements 31 of the folder are moved away from the inner flap, allowing the outer flap, pressed by the closing member, to impact the inner flap. In this position the inner and outer flaps are brought into relative overlap and pressed against each other by the pressure exerted by the closing member 22 as well as abutted by the side wall 16 of the mandrel.

The relative positioning and the timing of the movements of the mandrel 10, of the closing member 22 and of the hitting elements 31 of the folding device are configured so that it is ensured that the outer flap, at the moment of the impact with the inner flap comes into contact with the inner flap folded substantially at 90°, near the wall 16 of the mandrel, so as to ensure that the inner and outer flaps can correctly overlap each other to cause a precise gluing thereof.

The profiles of the end edges 33 of the plates 32 have, in the axial direction, an extension such as to press, together, the inner flap 7*f* for a prevailing portion of its dimension developed along the lower folding edge 18*a* of the mandrel around which the inner flap is folded. In this way it is ensured that the inner flap can be effectively yielded along a prevailing portion of the respective folding line.

As shown in FIG. 3, the rotation axis X is tilted by an angle A (measured in a vertical plane containing the axis X) with respect to a horizontal movement plane of the mandrel, which contains the circular trajectory thereof.

Furthermore, the end edges 33 of the plates 32 are configured to extend substantially parallel to the folding edges of the mandrel when the folding device abuts the inner flap 7*f* (FIG. 6). This configuration causes the end edges 33 of the plates 32 to be driven, in the rotation about the axis X, along a trajectory with a conical surface profile, such a trajectory allowing the end edges 33 to impact the inner flap while remaining substantially parallel to the corresponding folding edge of the mandrel moving along a circular trajectory. It follows that the inner flap is impacted by the edges of the plates with a pressure distributed substantially uniformly along the surface development of the inner flap.

The angle A of inclination is linked to some geometric magnitudes of the mandrel and the trajectory thereof, in particular it is related to the pitch diameter of the circular trajectory of the mandrel and to the dimension of the blank wrapped on it, measured in the radial direction.

The order of magnitude of the angle A of inclination is some degrees and in the example described herein is preferably chosen equal to 4.5°. It should be noted that the angle of inclination would be equal to 0° if the mandrel were moved along a straight trajectory.

It is also envisaged that the folding device 30 can be set in position, both in translation with respect to the movement plane of the mandrel, and angularly in order to anticipate or delay the step of folding the inner flap, in combination with the movement of the closing member. These adjustments, together with a possible retiming of the movement, are also suitable for the management of the format changes of the blanks fed to the packaging unit.

With reference to FIGS. 7 to 12, a second example of packaging unit made in accordance with the invention is described below, in which details common to those of the previous example are marked by the same reference numerals, while embodiment variants of details of the previous example are marked by the same reference numerals quoted with the addition of the graphic sign "'". In this example it is provided that the hitting element 31' of a folding device 30' is assembled on a retaining device of the blank, overall indicated with 40, arranged downstream of the folding device 5.

The retaining device 40 is movably guided along a section of the trajectory of movement of the mandrel and is configured to cooperate with the mandrel 10 in order to retain the opposite upper and lower panels 7*c*, 7*d* of the blank against the respective abutment surfaces of the mandrel, in the advancement movement of the mandrel along the trajectory, and in particular during the step of closing the box made by the closing member 22.

A second retaining device 41 is arranged downstream of the first retaining device 40 at a position spaced from the folding device 5 along the trajectory of the mandrel, and the retaining device 40 is therefore movable between the folding device 5 and the second retaining device 41.

The second retaining device 41 is made with a pair of parallel and opposite plates 42 mutually spaced so that the mandrel 10, in its advancement movement, can be driven therebetween at a close distance between each of the two plates and the lower and upper edges 18*a*, 18*b* of the side walls 15, 16 of the mandrel 10.

In greater detail, the first retaining device 40 comprises a pair of opposite arms 43, parallel and spaced apart, each arm being assembled, in a movably guided manner, on the respective plate 42, so as to be moved along the trajectory section between a first position, in which it is near the corresponding plate 42 and a second position in which it is moved to a position far from the corresponding plate 42. The movements of the arms 43 take place in respective horizontal planes parallel to each other as well as parallel to the plane containing the trajectory of movement of the mandrel 10.

The arms 43 are controlled in a synchronous movement, along a first stroke extended from the first to the second position, in a direction towards the mandrel 10, which is continued in a second return stroke, in the opposite direction, in which the arms 43 are driven accompanying the mandrel, in the same advancement direction and preferably with the same speed as the mandrel.

The distance between the arms 43 is chosen so that the mandrel 10, in its advancement movement, can slide therebetween at a close distance between each arm 43 and the folding edges of the mandrel 10 facing it.

Each arm 43 is provided with a plate-shaped end head 44 capable of retaining, in the accompanying movement of the mandrel, the corresponding panel of the blank in contact against the corresponding abutment surface of the mandrel. In other words, the head 44 overlying the mandrel 10, also referred to as the "upper head", retains the upper panel 7*c* of the blank against the corresponding upper abutment surface of the mandrel and the other head 44 underlying the mandrel, also referred to as the "lower head", retains the lower panel 7*d* of the blank against the corresponding lower abutment surface of the mandrel.

Each head 44 has a substantially "T" shape, in which the enlarged portion extends along a prevailing portion of the longitudinal dimension of the panels in the contact zone with the blank 7 and developed along the folding edges.

Each arm 43 is driven in its movement along the trajectory section by means of a respective driving device, indicated with 45, by means of which the corresponding arm 43 is driven in an oriented manner along the trajectory section. In an embodiment example, the driving device may comprise a mechanism for transmitting the motion of each arm 43 of the rack-pinion type, wherein a rack integrally connected to the arm 43 is coupled to a pinion that is driven to rotate by a drive member.

With reference to the folding device 30', the hitting element 31' comprises a plate 32' bearing an end edge 33' intended to press the inner flap 7*f* of the blank.

The plate 32' is hinged to the lower head 44, by means of a U-shaped bracket 46, the free ends 46*a,b* of which are connected to the plate 32'. On parts opposite to said free ends, the bracket is rotatably supported on the lower head by means of a pair of coaxial hinges that identify a swing axis Y of the plate 32'.

A cylindrical-shaped appendage 47 is assembled on the bracket 46 and which is slidably coupled in a seat 48 of a guide 49, so that the plate 32', moving solidly with the retaining device 40 is at the same time driven in an oscillatory movement with respect to the lower head 44, imposed by the movement of the guide 49.

For this purpose, the guide 49 is driven in an alternating movement, directed transversely to the trajectory of the mandrel, by means of a kinematic system of levers 50, coupled to the guide and driven by a motor 51.

In the swinging movement around the axis Y, the plate 32' is moved between a position close to the lower head, in which the plate is brought near the head to abut and fold the inner flap of the blank wrapped on the mandrel, and a position away from the head.

FIGS. 8 to 10 show a sequence of three significant positions assumed by the hitting element 31' of the folding device 30' in cooperation with the mandrel 10 and with the closing member 22.

FIG. 8 shows a position in which the closing member 22 and the folding device 30' are driven towards to the mandrel 10, which is advancing along its trajectory accompanied by the retaining device 40, whose heads 44 abut the blank against the mandrel. In this position the inner 7*f* and outer 7*e* flaps have not yet come into contact, respectively with the hitting element 31' of the folding device 30' and with the bar of the closing member 22.

FIG. 9 shows a subsequent position in which the closing member 22 reaches and presses the outer flap 7*e* being folded towards the mandrel and the hitting element 31' of the folding device reaches and presses the inner flap 7*f* being folded towards the mandrel. In the position of FIG. 9 the plate 32' of the folding device, in the swinging movement with respect to the lower head 44, is moving itself substantially parallel to the side wall 16 of the mandrel, so that the inner flap is folded substantially at 90° around the corresponding lower folding edge 18*a* of the mandrel. In this position the hitting element 31' is interposed between the outer flap, which continues to be pressed and folded by the closing member, and the inner flap, without however, during this combined movement, there being any contact between the outer flap 7*e* and the hitting element 31'.

In a subsequent position, shown in FIG. 10, the hitting element 31' of the folder is swung away from the lower head 44, allowing the outer flap 7*e*, pressed by the closing member 22, to impact the inner flap 7*f*. In this position the inner and outer flaps are in relative overlap and pressed against each other by the pressure exerted by the closing member 22 as well as abutted by the side wall 16 of the mandrel. In this step, gluing takes place between the inner and outer flaps to complete the partial closure of the box.

It should be observed that in the position illustrated in FIG. 10 the arms 43 have concluded the return stroke, ending the accompanying action of the mandrel. The latter, continuing in the advancement along its trajectory, is brought between the plates 42, to be delivered to an unloading station in which the box, the side closure having been completed, is extracted from the mandrel 10, and the mandrel is brought back in the loading zone.

The invention claimed is:

1. A packaging unit for packaging articles into boxes, comprising:

a mandrel configured to accommodate therein at least one of said articles, configured to move along a circular trajectory, and configured to be at least partially wrapped by a blank, said blank having an outer flap and an inner flap configured to be mutually overlapped and fixed to form a partially closed box, a closing member, assembled on the mandrel and following the mandrel in an advancement of the mandrel along the circular trajectory, and configured to fold the outer flap of the blank, and a folding device configured to abut and fold the inner flap of the blank in a direction of the mandrel when the blank is at least partially wrapped onto the mandrel.

2. The packaging unit according to claim 1, wherein said folding device comprises:

at least one hitting element movable with respect to the mandrel between a first position far from the mandrel and a second position close to the mandrel such that the inner flap is folded towards the mandrel, and a driving device for moving the at least one hitting element between said first and second positions.

3. The packaging unit according to claim 2, wherein said mandrel comprises a folding edge for the inner flap of the blank and said at least one hitting element is configured to press the inner flap.

4. The packaging unit according to claim 2, wherein said at least one hitting element comprises at least one plate bearing an end edge configured to press the inner flap of the blank.

5. The packaging unit according to claim 2, wherein said at least one hitting element is moved between said first and second positions by a rotation motion about a rotation axis.

6. The packaging unit according to claim 5, wherein said at least one hitting element extends radially to the rotation axis.

7. The packaging unit according to claim 5, wherein the mandrel is moved along the circular trajectory contained in a movement plane, said rotation axis being tilted with respect to said movement plane and an end edge of the at least one hitting element extending parallel to said movement plane, so that said end edge is substantially parallel to a folding edge of the mandrel in the second position.

8. The packaging unit according to claim 7, wherein the end edge of the at least one hitting element is driven to rotate about said rotation axis along a trajectory with a conical surface profile.

9. The packaging unit according to claim 2, further comprising a retaining device movably guided along at least a section of the circular trajectory of movement of the mandrel and configured to cooperate with the mandrel for retaining the blank wrapped on the mandrel against at least one abutment surface of the mandrel, wherein the at least one hitting element of the folding device is assembled on said retaining device.

10. The packaging unit according to claim 9, wherein:

said retaining device comprises a plate-shaped head and said at least one hitting element is hinged to said plate-shaped head, and is configured to swing between said first position and said second position.

11. The packaging unit according to claim 10, wherein said at least one hitting element comprises an appendage slidably coupled to a guide driven transversely to the trajectory of movement of the mandrel, so that in a movement of the retaining device the hitting element is moved between said first position and second position.

12. A method for packaging articles into boxes, comprising:

moving a mandrel along a circular trajectory, arranging a blank at least partially wrapped around the mandrel containing therein one or more of said articles, to form a partially closed box around the mandrel and such that the at least partially wrapped blank has an outer flap and an inner flap configured to be mutually overlapped and fixed to form the partially closed box, folding by a closing device the outer flap, the closing device following the mandrel along the circular trajectory, and abutting and folding by a folding device the inner flap in a direction of the mandrel by moving said folding device towards the mandrel when the blank is at least partially wrapped onto the mandrel.

13. The packaging method according to claim 12, further comprising:

arranging and moving at least one hitting element of said folding device with respect to the mandrel between a first position far from the mandrel and a second position close to the mandrel for folding the inner flap of the blank in the direction of the mandrel.

14. The packaging method according to claim 13, further comprising:

moving the at least one hitting element between said first position and said second position by a rotation movement driven around a rotation axis.

15. The packaging method according to claim 13, further comprising:

arranging and guiding a retaining device along at least a section of the circular trajectory of movement of the mandrel, said retaining device being configured to cooperate with the mandrel for retaining the blank wrapped on the mandrel against at least one abutment surface of the mandrel, and assembling the at least one hitting element of the folding device on said retaining device.

16. The packaging method according to claim 15, further comprising:

driving the at least one hitting element of the folding device in a swinging movement relative to the retaining device between said first position and second position.

* * * * *